US006158985A

United States Patent [19]

Watanabe et al.

[11] Patent Number: 6,158,985

[45] Date of Patent: Dec. 12, 2000

[54] AIR FAN INCLUDING WATERPROOF STRUCTURE

[75] Inventors: Michinori Watanabe; Kesatsugu Watanabe; Akiyoshi Kuroda, all of Tokyo, Japan

[73] Assignee: Sanyo Denki Co., Ltd., Tokyo, Japan

[21] Appl. No.: 09/413,561

[22] Filed: Oct. 6, 1999

[30] Foreign Application Priority Data

Oct. 7, 1998 [JP] Japan ..... 10-285619

[51] Int. Cl.[7] ..... F04B 17/00

[52] U.S. Cl. ..... 417/423.14

[58] Field of Search ..... 417/423.14, 423.17

[56] References Cited

U.S. PATENT DOCUMENTS

| | | | |
|---|---|---|---|
| 4,959,571 | 9/1990 | Yasumoto et al. . | |
| 5,028,216 | 7/1991 | Harmsen et al. . | |
| 5,135,363 | 8/1992 | Harmsen et al. | 417/354 |
| 5,245,236 | 9/1993 | Horng | 310/67 R |
| 5,492,458 | 2/1996 | Horng | 417/423.7 |
| 5,701,045 | 12/1997 | Yokozawa et al. | 310/62 |
| 5,810,554 | 9/1998 | Yokozawa et al. | 415/176 |
| 5,879,141 | 3/1999 | Yokozawa et al. | 415/176 |
| 5,910,694 | 6/1999 | Yokozawa et al. | 310/89 |
| 6,079,958 | 6/2000 | Qandil | 417/319 |

*Primary Examiner*—Teresa Walberg
*Assistant Examiner*—Vinod D. Patel
*Attorney, Agent, or Firm*—Pearne & Gordon LLP

[57] ABSTRACT

An air fan capable of exhibiting an enhanced waterproof function while being simplified in structure. An end of an outer cylindrical wall of a motor support and that of a blade mounting wall are so formed that the end of the outer cylindrical wall is positioned outside the end of the blade mounting wall and a gap constituting a labyrinth structure is defined between both ends. The motor support also includes an inner cylindrical wall, which is fixedly mounted on an end thereof with a flange member including an annular flange extending outwardly in a radial direction. The inner cylindrical wall has a Length in an axial direction determined so that the annular flange is positioned in proximity to a suction port as compared with an outer opening of the gap.

12 Claims, 5 Drawing Sheets

(A)

(B)

(C)

AIR FAN INCLUDING WATERPROOF STRUCTURE

BACKGROUND OF THE INVENTION

This invention relates to an air fan, and more particularly to an air fan using a motor as a drive source.

An air fan which has been conventionally known in the art is constructed in such a manner as disclosed in U.S. Pat. No. 4,959,571, U.S. Pat. No. 5,028,216 or the like by way of example. More particularly, the conventional air fan includes a motor support arranged in a casing so as to fixedly mount a stator of a motor thereon and an impeller fixed with respect to a rotor of the motor and having a plurality of blades mounted on an outer periphery of a cylindrical or cup-like member, wherein the motor support and impeller are arranged opposite to each other with a gap being defined therebetween.

Unfortunately, such a conventional air fan fails to a waterproof function. Thus, arrangement of the air fan in an environment in which it is vigorously exposed to rain causes water to intrude into the motor, leading to a failure in operation of the motor and therefore that of the air fan.

SUMMARY OF THE INVENTION

The present invention has been made in view of the foregoing disadvantage of the prior art.

Accordingly, it is an object of the present invention to provide an air fan which is capable of exhibiting an enhanced waterproof function.

It is another object of the present invention to provide an air fan which includes a waterproof structure exhibiting a satisfactory waterproof function irrespective of both a posture in which the air fan is operated and a direction in which it is arranged.

It is a further object of the present invention to provide a waterproof air fan which is capable of facilitating manufacturing thereof.

In accordance with the present invention, an air fan is provided, which is adapted to forcedly feed air in an axial direction of a revolving shaft of a motor while acting the motor as a drive source therefor. The motor includes a stator fixed on a motor support. The motor support includes a base wall provided at a central portion thereof with a bearing holder fixedly mounted therein with bearings for supporting a revolving shaft of the motor and arranged so as to extend in a radial direction perpendicular to the axial direction of the revolving shaft and an outer cylindrical wall arranged so as to extend from an outer periphery of the base wall toward an air suction side and provided with an opening which is open toward the air suction side and on which a stator of the motor is fixedly mounted. The air fan also includes an impeller fixed with respect to a rotor of said motor and including a plurality of blades. As in a conventional air fan, the impeller includes a blade mounting wall of a cylindrical shape arranged outside the rotor and mounted on an outer periphery thereof with the blades. The blade mounting wall is provided with an opening which is open toward an air discharge side.

The outer cylindrical wall has an opening-side end positioned on a side of the opening of the outer cylindrical wall and the blade mounting wall has an opening-side end positioned on a side of the opening of the blade mounting wall. The opening-side ends of the outer cylindrical wall and blade mounting wall are so formed that the opening-side end of the outer cylindrical wall is positioned outside the opening-side end of the blade mounting wall and a gap constituting a labyrinth structure is defined between the opening-side ends. "The gap constituting the labyrinth" indicates a gap defined between opposite ends of two cylindrical members rotated relatively to each other. The gap is formed so as to substantially prevent water or dust-containing gas from intruding into the two cylindrical members through the gap. "The gap constituting the labyrinth" sufficiently exhibits its function when at least one of the cylindrical members is being rotated. Thus, the gap possibly causes water to intrude into the cylindrical members through the gap depending on a posture of the air fan.

Such a gap may include a first annular passage extending inwardly in the radial direction from an outer opening thereof, a cylindrical passage extending toward the air discharge side while communicating with the first annular passage, and a second annular passage extending inwardly in the radial direction so as to permit the cylindrical passage to communicate with an inner opening thereof. Such construction of the gap facilitates both design of the gap and formation thereof.

The gap may include an outer annular opening which is open outwardly in the radial direction and an inner annular opening which is open inwardly in the radial direction, wherein the outer annular opening is positioned in proximity to the air suction side as compared with the inner annular opening. The inner and outer cylindrical walls may be formed into any desired shape. In the illustrated embodiment, the base wall of the motor support is provided at a portion thereof positioned inwardly of the outer cylindrical wall with an inner cylindrical wall, which is arranged in a manner to extend toward the air suction side and provided with an opening open toward the air suction side. The inner cylindrical wall is provided at an opening-side end thereof positioned on a side of the opening thereof with an annular flange so as to extend outwardly in the radial direction. The annular flange is positioned in proximity to the air suction side as compared with the outer opening of the gap. Such construction facilitates manufacturing of the flange and ensures formation of the flange of a shape desired depending on applications thereof.

In particular, in the present invention, the annular flange is positioned in proximity to the air suction side as compared with the outer opening of the gap. More particularly, the inner cylindrical wall has a length in the axial direction determined so that the annular flange is positioned in proximity to the air suction side as compared with the outer opening of the gap or between the outer opening and the air suction side. Supposing that the air fan of the present invention is operated while keeping the revolving shaft horizontal and keeping actuation of the motor stopped, such situation possibly causes water to intrude into the motor support through the gap constituting the labyrinth structure. However, the above-described construction of the present invention permits water intruding into the motor support from above the gap to flow out from below the gap through an outer periphery of the inner cylindrical wall. Arrangement of the annular flange prevents water entering the motor support from intruding into the inner cylindrical wall beyond the annular flange, even when the air fan is somewhat inclined. Also, supposing that the air fan is exposed to rain when the air fan is operated so as to downwardly suck air while keeping the revolving shaft vertical and keeping the motor stopped, such situation causes water flowing down along an outer surface of the blade mounting wall of the impeller to intrude into the motor support through the outer opening of the gap. The water thus intruding into the motor support is then collected in a space defined by cooperation of the outer cylindrical wall, base wall and inner cylindrical wall. However, the water is prevented from being collected in the space to a level above the outer opening of the gap. More particularly, the annular flange of the inner cylindrical wall is positioned above the outer opening of the gap, resulting in water being prevented from intruding into the inner cylindrical wall even when vibration of an increased magnitude is applied to the air fan while keeping water collected in the space. Rotation of the air fan causes a negative pressure to be produced around the outer opening of the gap positioned downstream of the impeller, so that water collected in the gap is drawn out from the gap and outwardly discharged due to gradual vaporization in a certain period of time. Further, supposing that the air fan is exposed to rain when the air fan is operated so as to upwardly suck air while keeping the revolving shaft vertical and keeping actuation of the motor stopped, such situation causes the outer opening of the gap to be located below the inner opening thereof, to thereby prevent water from intruding into the motor support through the gap. Thus, it will be noted that the present invention exhibits a satisfactory waterproof function while simplifying the waterproof structure. Also, such an increased waterproof function is ensured irrespective of a posture in which the air fan is operated.

The annular flange is merely required to extend outwardly in the radial direction to a degree sufficient to prevent water intruding into the space between the outer-cylindrical wall and the inner cylindrical wall through the gap from overflowing the flange. Thus, in general, an increase in dimension of the flange in the radial direction permits the flange to more effectively exhibit the function. However, the dimension may be suitably determined depending on applications of the air fan.

The annular flange may be provided with a first auxiliary cylindrical wall. The first auxiliary cylindrical wall may be arranged so as to extend toward the air suction side, have an opening open toward the air suction side and be positioned concentrically with the revolving shaft. Also, the impeller may be integrally provided with a second auxiliary cylindrical wall, which is arranged so as to be concentric with the revolving shaft on an outside of the rotor on an inner side of the blade mounting wall in the radial direction and provided with an opening which is open toward the air discharge side. An opening-side end of the first auxiliary cylindrical wall which is positioned on a side of the opening thereof and an opening-side end of the second auxiliary cylindrical wall which is positioned on a side of the opening thereof are so formed that the opening-side end of the first auxiliary cylindrical wall is positioned outside the opening-side end of the second auxiliary cylindrical wall and a gap constituting a labyrinth structure is formed between both opening-side ends. Such arrangement provides a dual labyrinth structure. Thus, even when vigorous vibration is applied to the air fan while keeping water collected in the motor support, the present invention prevents the water from intruding into the stator and rotor of the motor, resulting in exhibiting an enhanced waterproof function. The first auxiliary cylindrical wall may be integrally provided on a radially outward end of the flange. This results in the air fan being significantly simplified in structure.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an air fan according to the present invention will be detailedly described hereinafter with reference to the accompanying drawings.

Figure 1:
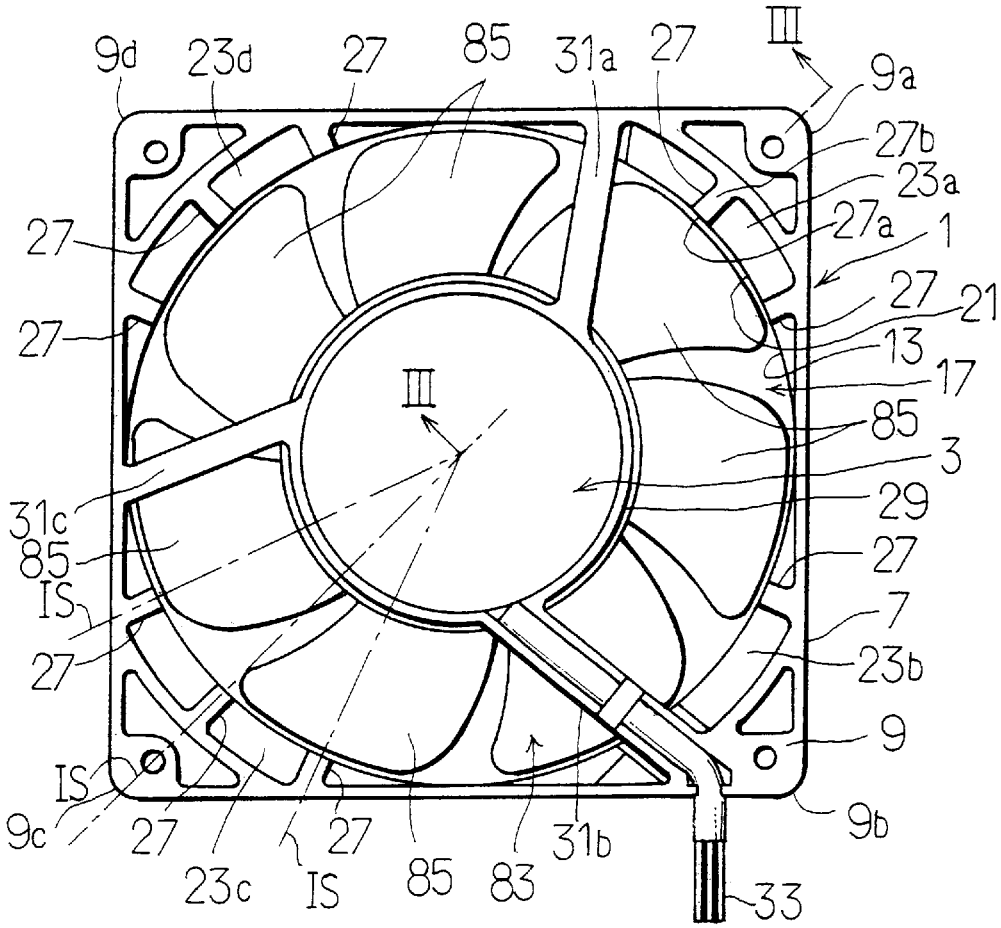
FIG. 1 is a plan view showing an embodiment of an air fan according to the present invention in the form of an axial fan, which is viewed from an air discharge side thereof.
Figure 2:
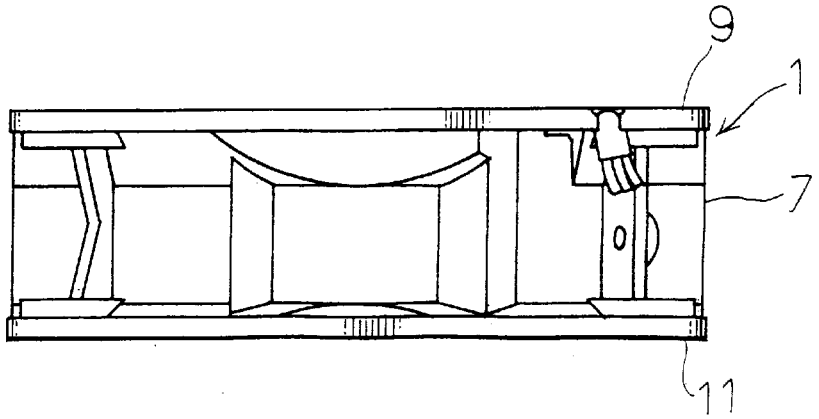
FIG. 2 is a front elevation view of the axial fan shown in FIG. 1.
Figure 3:
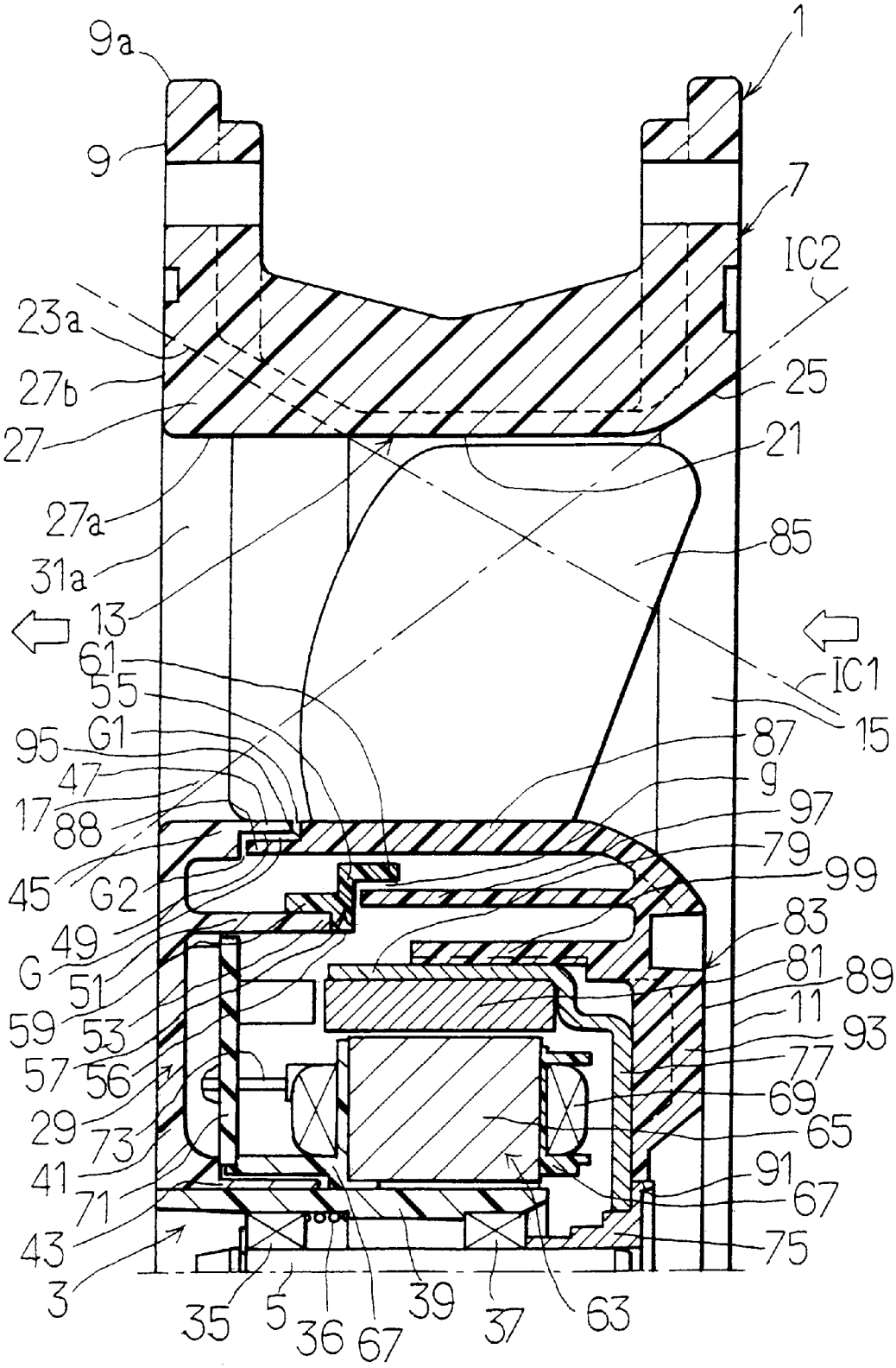
FIG. 3 is a sectional view taken along line III—III of FIG. 1.

Referring first to FIGS. 1 to 3, an embodiment of an air fan according to the present invention is illustrated. An air fan of the illustrated embodiment which is generally designated at reference numeral 1 includes a motor 3 acting as a drive source and including a revolving shaft 5 and is constructed so as to suck air from one side defined in an axial direction of the revolving shaft or an air suction side and discharge the air to the other side in the axial direction or an air discharge side. In FIG. 1, a rear side of the sheet of the view and a front side thereof are the air suction side and air discharge side, respectively. In FIG. 3, a right-hand side of the sheet and a left-hand side thereof are the air suction side and air discharge side, respectively. In FIG. 3, void arrows indicate a direction in which air flows.

The air fan of the illustrated embodiment also includes a casing 7, which is formed of a synthetic resin material and has two surfaces or front and rear side surfaces 9 and 11 defined on both sides thereof in an axial direction thereof. The side surfaces 9 and 11 each are formed into a rectangular or substantially square shape. Alternatively, the casing 7 may be formed of aluminum by die casting. The casing 7 has an inner cylindrical surface 13 defined therein so as to be positioned at a central portion thereof, resulting in constituting an air duct. The air duct has a suction port 15 defined on one side thereof in the axial direction of the air fan or casing or the air suction side. Also, it has an air discharge port 17 defined on the other side thereof or the air discharge side. The inner cylindrical surface 13, as shown in FIG. 3, is formed at a central portion thereof with a cylindrical surface 21 in a manner to be concentric with an axis of the revolving shaft 5. The cylindrical inner surface 13 is formed with four discharge-side tapered or inclined surfaces 23*a* to 23*d* in a manner to positionally correspond to four corners 9*a* to 9*d* (FIG. 1) on the front side surface 9 of the casing 7 while being adjacent to the discharge port 1. Four such tapered surfaces 23*a* to 23*d* each are formed so as to be expanded or enlarged outwardly in a radial direction of the revolving shaft 5 toward the discharge port 17. More specifically, the discharge-side tapered surfaces 23*a* to 23*d* each are formed so as to have an apex defined on the axis of the revolving shaft 5 and constitute a part of a first virtual conical surface IC1 positioned on a side of the suction port 15. In FIG. 3, a tangent line of the virtual conical surface is indicated at dashed lines. In other words, the discharge-side tapered surfaces 23*a* to 23*d* each are defined in a manner to be concentric with the revolving shaft 5 and constitute a part of the virtual frust-conical surface expanded in a diameter toward the discharge port 17.

The cylindrical inner surface 13 of the casing 7 is formed with four suction-side tapered surfaces 25 in a manner to positionally correspond to four corners on the rear side surface 11 on the side of the suction port 15 while being adjacent to the suction port. In FIG. 3, only one such suction-side tapered surface 25 is illustrated for the sake of brevity. Four such suction-side tapered surfaces 25 are likewise arranged so as to have an apex defined substantially on the axis of the revolving shaft 5 of the motor 3 and constitute a part of a second virtual conical surface IC2 defined on the side of the discharge port 17.

In the illustrated embodiment, the discharge-side tapered surfaces 23*a* to 23*d* each are integrally formed with at least one fin 27 so as to extend radially inwardly and toward the discharge port 17 from the tapered surface. In the illustrated embodiment, one to three such fins 27 are arranged on each of the tapered surfaces 23*a* to 23*d*. One or more such fins 27 arranged on each of the discharge-side tapered surfaces function to reduce noise generated when the axial fan 1 is operated to provide a practical flow rate of air. In the illustrated embodiment, three webs 31*a* to 31*c* for connecting a motor support 29 and the casing 7 to each other are arranged in the discharge port 17 as detailedly described hereinafter; so that three fins 27 are arranged on each of the discharge-side tapered surfaces 23*a* and 23*d*, whereas two fins 27 and only one fin 27 are arranged on the tapered surfaces 23*a* and 23*b*, respectively. If the webs 31*a* to 31*c* are not arranged on the side of the suction port 15, twelve fins 27 would be arranged on each of the discharge-side tapered surfaces 23*a* to 23*d*. Supposing that the tapered surfaces formed on the side of the discharge port 17 each are formed into a complete frust-conical shape as in a conventional large-sized axial fan, the fins 27 are provided by a part of sixteen fins arranged so that an angular interval between each adjacent two fins is about 22.5 degrees.

The fins 27 each are arranged so as to extend along a virtual plane IS (FIG. 1) extending in both an axial direction and a radial direction about the axis of the revolving shaft 5. Also, the fins 27, as shown in FIG. 3, each have an end surface 27*a* facing radially inwardly, which is arranged so as to be flush with the cylindrical surface 21 of the cylindrical inner surface 13. Also, the fins each have an end surface 27*b* facing the discharge port 27*b*, which is arranged so as to be flush with the upper side surface 9 of the casing 7 facing the discharge port 17. Such arrangement of the fins prevents the fins 27 from disturbing flow of air discharged from the cylindrical surface 21 and keeps the axial fan from being increased in length thereof in the axial direction thereof.

The motor support 29 is formed integrally with the casing 7 and webs 31*a* to 31*c* and arranged in the air duct constituted by the cylindrical inner surface 13 together with the webs 31*a* to 31*c*. In the illustrated embodiment, three such webs 31*a* to 31*c* are arranged so as to obliquely extend. However, the number of webs and a configuration thereof may be determined as desired. The web 31*b* has a cable 33 supported thereon, which is connected to a drive circuit for the motor 3. The motor support 29 is provided on a central portion thereof with a bearing holder 39 of a cylindrical shape, on which bearings 35 and 37 for supporting the revolving shaft 5 of the motor 3 are fixed. Also, the motor support 29 includes a plate-like base wall 41 arranged so as to extend in a radial direction perpendicular to the axial direction of the revolving shaft 5. Reference numeral 36 designates a coiled spring. In the illustrated embodiment, the base wall 41 is integrally formed at a central portion thereof with a boss 43, in which the bearing holder 39 provided separately from the boss 43 is fitted at a base portion thereof. Alternatively, the bearing holder 39 may be provided by extending the boss 43. In this instance, the base wall 41 and bearing holder 39 are formed integrally with each other.

The motor support 29 includes an outer cylindrical wall 45 and an inner cylindrical wall 51 which are formed integrally with each other. The outer cylindrical wall 45 is arranged concentrically with the revolving shaft 5 and so as to extend from an outer periphery of the base wall 41 toward the air suction side or the suction port 15. Also, the outer cylindrical wall 45 is provided at an end thereof with an opening which is open toward the air suction side. The end 47 of the outer cylindrical wall 45 is formed on an inner periphery thereof with an annular step 49 for providing a gap G which constitutes a first labyrinth structure described hereinafter. In the illustrated embodiment, the gap G includes an outer annular opening G1 which is open outwardly in a radial direction thereof and an inner annular opening G2 which is open inwardly in the radial direction. The outer opening G1 is defined in proximity to the air suction side or suction port 15 as compared with the inner opening G2 or between the suction port 15 and the inner opening G2. Thus, the gap G includes a first annular passage extending inwardly in the radial direction from the outer opening G1, a cylindrical passage extending toward the air discharge side or discharge port 17 while communicating with the first annular passage, and a second annular passage extending inwardly in the radial direction so as to communicate the cylindrical passage with the inner opening G2.

The inner cylindrical wall 51 is positioned inwardly in the radial direction as compared with the outer cylindrical wall 45 and outwardly in the radial direction as compared with a stator 63 described hereinafter. The inner cylindrical wall 51 includes an opening which extends toward the air suction side or suction port 15 and is open toward the air suction side. The inner cylindrical wall 51 is fixedly mounted on an end 53 thereof positioned on a side of the opening with a flange member 57 made of a synthetic resin material and including an annular flange 55 arranged so as to extend outwardly in the radial direction. The inner cylindrical wall 51 has a length in the axial direction determined so as to permit the annular flange 55 to be positioned in proximity to the air suction side or suction port 15 as compared with the outer opening G1 of the gap G or between the outer opening G1 of the gap G and the suction port 15. The flange member 57 includes a cylindrical section 59 fitted on an outer periphery of the end 53 of the inner cylindrical wall 51, the above-described annular flange 55 extending outwardly in the radial direction from an end of the cylindrical section 59, a first auxiliary cylindrical wall 61 integrally provided on the end of a radially outwardly extending annular flange 55, and an annular stopper wall 56 integrally provided on a radially inward end of the annular flange 55 and abutted against an end surface of the end 53 of the inner cylindrical wall 51. The first auxiliary cylindrical wall 61 is formed so as to extend toward the suction port 15 and has an opening arranged so as to be open toward the suction port 15. Also, the first auxiliary cylindrical wall 61 is arranged so as to be concentric with the revolving shaft 5. The cylindrical section 59 may be joined to the end of the inner cylindrical wall 51 by any suitable conventional joint techniques such as ultrasonic welding or the like.

The bearing holder 39 is fixedly mounted on an outer periphery thereof with the stator of the motor 3 briefly described above. In the illustrated embodiment, the motor 3 may be constituted by a brushless DC motor. The stator 63 includes a stator core 65, an insulator 67 for insulation fitted on the stator core 65 and a winding 69 wound on a magnetic pole section of the stator core 65 through the insulator 67. The winding 69 of the stator 63 is connected through a connection conductor 73 to a drive circuit formed on a circuit board 71 arranged in the inner cylindrical wall 51 of the motor support 29. The circuit board 71 is positioned on a rib provided on an inner periphery of the inner cylindrical wall 51 and an annular rib arranged on an outer periphery of the boss 43.

The suction port 15 of the revolving shaft 5 is fitted on an end thereof with a cylindrical boss 75, which is mounted thereon with a cup member 77 and an impeller 83. The cup member 77 includes a peripheral wall 77, which has a plurality of permanent magnets 81 joined to an inner periphery thereof in a manner to be opposite to the magnetic pole section of the stator 63. The revolving shaft 5, boss 75, cup member 77 and permanent magnets 81 cooperate with each other to constitute a rotor of the motor 3.

The impeller 83 includes a cup member 89 fitted on the cup member 77 and including a cylindrical blade mounting wall 87 arranged outside the rotor and mounted on an outer periphery thereof with a plurality of blades 85. The cup member 89 includes a base wall 93 formed at a central portion thereof with a fit hole 91 in which the boss 75 is fitted and arranged so as to extend in a radial direction thereof, as well as the cylindrical blade mounting wall or peripheral wall 87 arranged so as to extend from an outer periphery of the base wall 93 toward the air discharge side or discharge port 17 provided at an end 88 thereof with an opening. The opening-side end 88 of the cylindrical blade mounting wall 87 is formed on an outer periphery thereof with an annular step 95, which is arranged so as to be opposite to the annular step 49 formed on the end 47 of the outer cylindrical wall 45, to thereby form the gap G providing the labyrinth structure. In the illustrated embodiment, the opening-side end 47 of the outer cylindrical wall 45 of the motor support 29 and the opening-side end 88 of the blade mounting wall 87 of the impeller 83 are formed so as to permit the end 47 of the outer cylindrical wall 45 of the motor support 29 to be positioned outside the end 88 of the blade mounting wall 87 and permit the gas G constituting the labyrinth structure to be formed between the ends 48 and 88.

The base wall 93 of the cup member 89 of the impeller 83 is integrally provided with a second auxiliary cylindrical wall 97 and a cylindrical wall 99 fitted on the peripheral wall 79 of the cup member 77 of the rotor of the motor 3. The second auxiliary cylindrical wall 97 is arranged so as to be concentric with the revolving shaft 5 on an outside of the rotor on an inner side of the blade mounting wall 87 in the radial direction and provided at an opening-side end thereof with an opening which is open toward the air discharge side or discharge port 17. The opening-side end of the first auxiliary cylindrical wall 61 of the motor support 29 and the opening-side end of the second auxiliary cylindrical wall 97 are so formed that the opening-side end of the first auxiliary cylindrical wall 61 is positioned outside the opening-side end of the second auxiliary cylindrical wall 97 and a gap g constituting a second labyrinth structure is formed between both ends. Such arrangement permits the gaps G and g to cooperate together to provide a dual labyrinth structure. This effectively prevents water from intruding into the stator and rotor of the motor 3, resulting in the air fan exhibiting substantially enhanced waterproof performance, even when strong vibration is applied to the air fan while keeping water collected in a space defined between the outer cylindrical wall 45 of the motor support 29 and the inner cylindrical wall 51.

Figure 4:
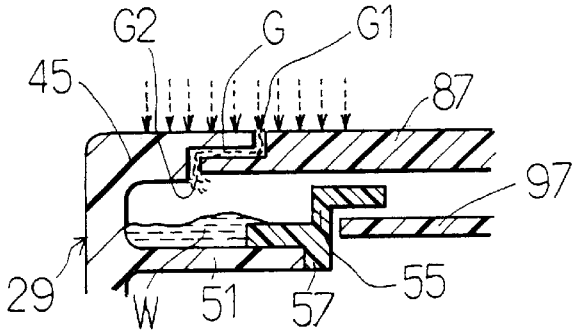
FIGS. 4A to 4C each are a sectional view showing a function of a waterproof structure depending on a posture in which an air fan is arranged.
Figure 4:
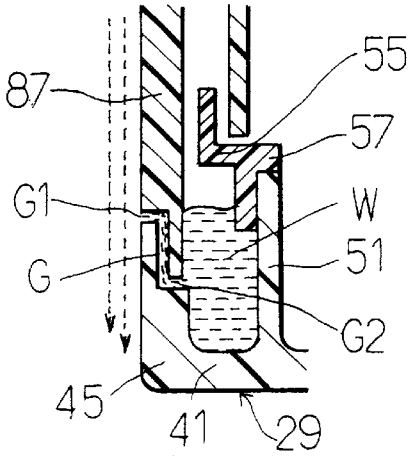
Figure 4:
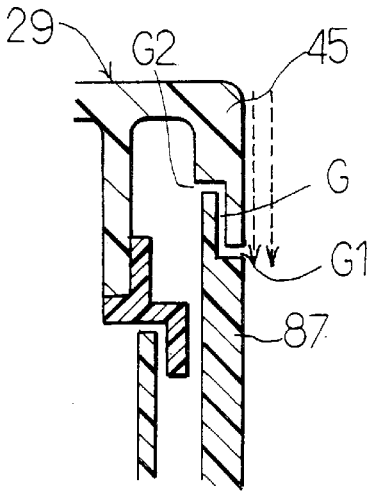

Now, the manner of operation of the waterproof structure incorporated in the air fan of the illustrated embodiment and constructed as described above will be described hereinafter with reference to FIGS. 4A to 4C, wherein rain to which the air fan is exposed is indicated by arrows of broken lines. First, the description will be made in connection with the case or situation that the air fan is exposed to rain when the air fan 1 is operated while keeping the revolving shaft 5 horizontal and keeping actuation of the motor stopped, as shown in FIG. 4A. Such situation possibly causes rain water to intrude into the motor support 29 through the gap G constituting the labyrinth structure. Thus, water W which has intruded into the motor support 29 through a portion of the motor support which is open toward an upper portion of the outer opening G1 of the gap G is permitted to flow along an outer periphery of the inner cylindrical wall 51, resulting in flowing out of a portion of the motor support 29 positioned below the gap G. Arrangement of the annular flange 55 in the illustrated embodiment effectively prevents water entering the motor support 29 from intruding into the inner cylindrical wall 51 beyond the annular flange even when the air fan 1 is operated while being kept somewhat inclined.

Then, the case that the air fan is exposed to rain when the air fan is operated while keeping the revolving shaft 5 vertical to downwardly suck air and keeping the motor stopped as shown in FIG. 4B will be discussed. Such situation causes water flowing down along an outer surface of the blade mounting wall 87 of the impeller 83 to intrude into the motor support 29 from the outer opening G1 of the gap G. Then, water thus intruding into the motor support 29 is collected in a space defined by cooperation of the outer cylindrical wall 45, base wall 41 and inner cylindrical wall 51. However, the illustrated embodiment prevents the water from being collected in the space to a level above the outer opening G1 of the gap G. Also, in the situation, the water is prevented from intruding into the inner cylindrical wall 51 even when vibration of an increased magnitude is applied to the air fan while keeping water collected in the space, because the annular flange 55 is arranged so as to be positioned above the outer opening G1 of the gap G. When the air fan is driven or rotated, a negative pressure is created around the outer opening G1 of the gap G defined downstream of the impeller, resulting in water collected in the gap G being gradually drawn out. Also, the water is discharged due to vaporization in a certain period of time.

Then, the situation that the air fan is exposed to rain when the air fan is operated while keeping the revolving shaft 5 vertical to upwardly suck air and keeping actuation of the motor stopped as shown in FIG. 4C will be discussed. Such situation results in the outer opening G1 of the gap G being positioned below the inner opening G2, to thereby prevent water from intruding into the motor support 29 through the gap. Thus, it will be noted that the waterproof structure incorporated in the air fan of the illustrated embodiment effectively prevents water from intruding into the air fan irrespective of a posture in which the air fan is operated and a direction in which it is arranged.

Figure 5:
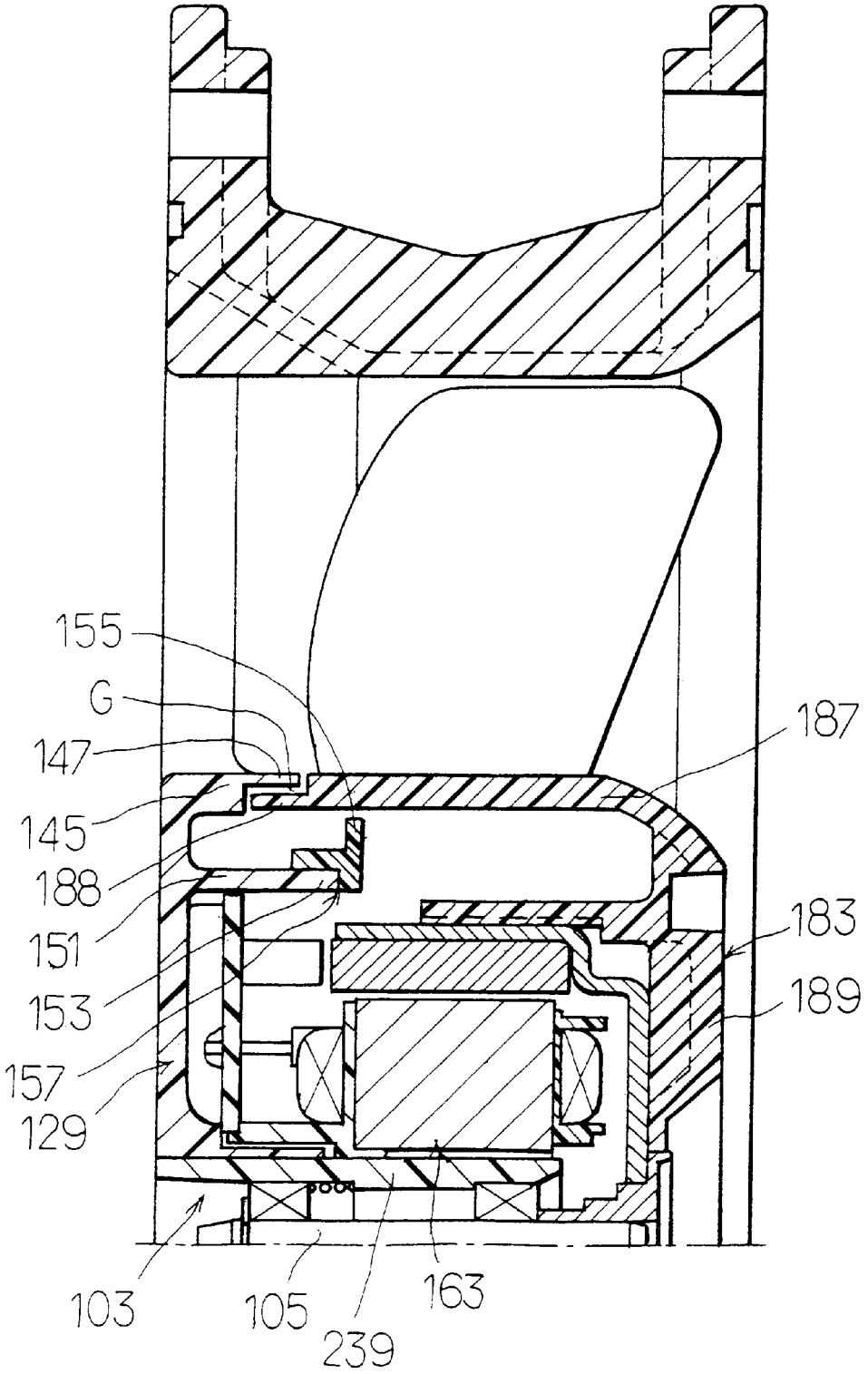
FIG. 5 is a sectional view like FIG. 3 showing an essential part of another embodiment of an air fan according to the present invention.

Referring now to FIG. 5, an essential part of another embodiment of an air fan according to the present invention is illustrated. In connection with the illustrated embodiment, reference numerals correspond to those discussed in the embodiment described above with reference to FIG. 3, except with an additional prefix of 100. The illustrated embodiment is different from that shown in FIGS. 1 to 3 in that a second labyrinth structure is not arranged in the former. More particularly, in an air fan of the illustrated embodiment, a flange member 157 includes no first auxiliary cylindrical wall and a cup member 189 of an impeller 183 including a blade mounting wall 187 includes no second auxiliary cylindrical wall. The remaining part of the illustrated embodiment may be constructed in substantially the same manner as the embodiment shown in FIG. 3. Such construction of the illustrated embodiment likewise permits the air fan to exhibit a sufficient waterproof function irrespective of a posture in which the air fan is operated and a direction in which it is arranged.

Figure 6:
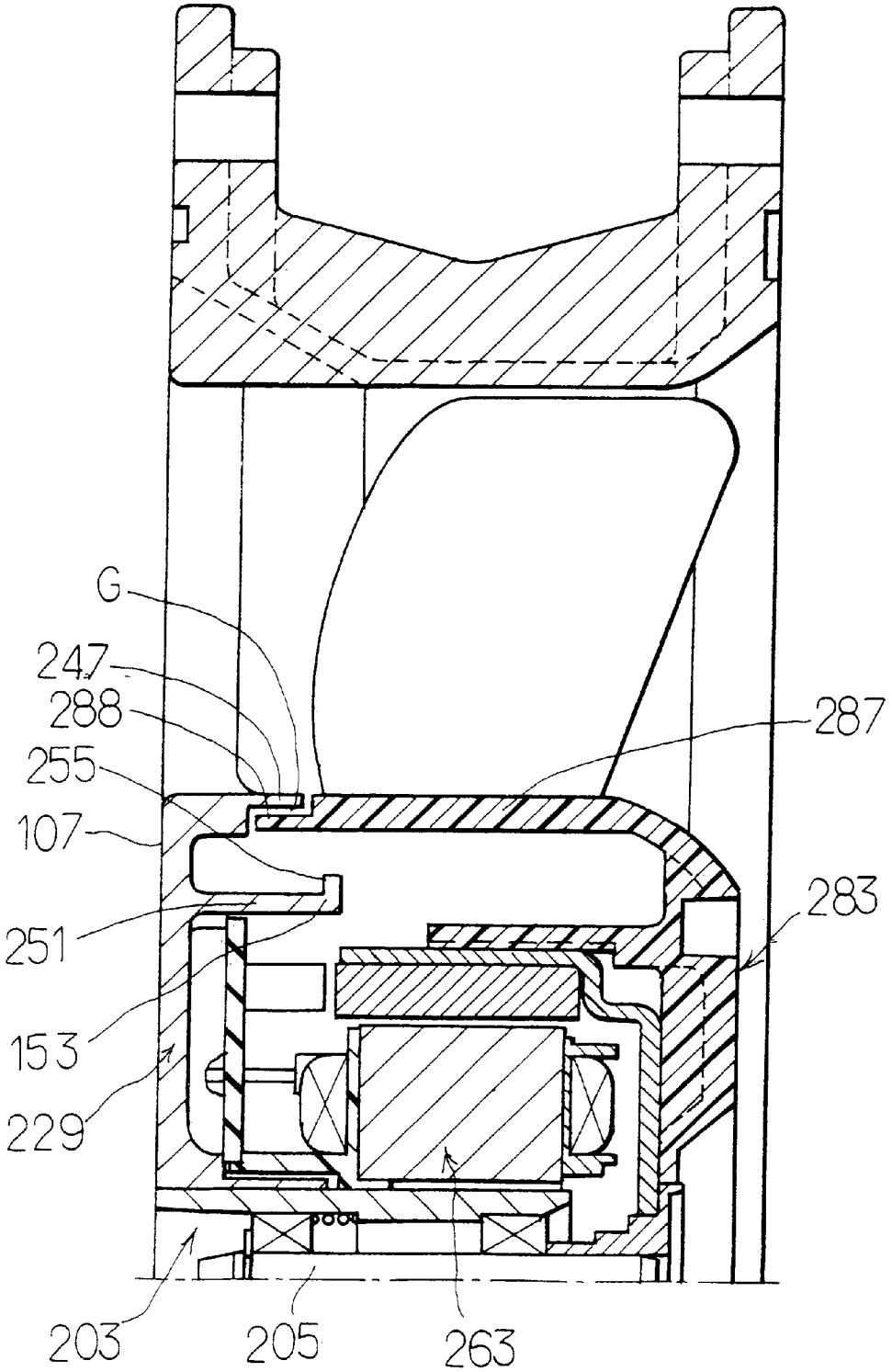
FIG. 6 is a sectional view like FIG. 5 showing an essential part of a further embodiment of an air fan according to the present invention.

Referring now to FIG. 6, a further embodiment of an air fan according to the present invention is illustrated. In connection with the illustrated embodiment, reference numerals correspond to those discussed in the embodiment described above with reference to FIG. 5, except with an additional prefix of 200. An air fan of the illustrated embodiment is different from the embodiment shown in FIG. 5 in that a casing is made of aluminum by die casting and an annular flange 255 is integrally provided on an end of an inner cylindrical wall 251. The annular flange 255 may be readily formed by increasing a thickness of the inner cylindrical wall 251 and subjecting it to cutting. The remaining part of the illustrated embodiment may be constructed in substantially the same manner as that shown in FIG. 3.

The embodiments described above each have been described in connection with the axial fan. However, the present invention may be effectively applied to a mixed flow fan for discharging air in a direction at an angle with respect to an axial direction thereof or the like. Also, in the embodiment shown in FIGS. 1 to 3, the fins 27 are arranged on the discharge-side tapered surfaces 23*a* to 23*d*, to thereby reduce noise. However, the present invention may be applied to an air fan free of such fins.

As can be seen from the foregoing, the air fan of the present invention is simplified in structure and exhibits an enhanced waterproof function irrespective of a posture in which it is operated and a direction in which it is arranged.

What is claimed is:

1. An air fan having a motor incorporated therein so as to act as a drive source, comprising:

a motor support which includes a base wall provided at a central portion thereof with a bearing holder fixedly mounted therein with bearings for supporting a revolving shaft of said motor and arranged so as to extend in a radial direction perpendicular to an axial direction of said revolving shaft and an outer cylindrical wall arranged so as to extend from an outer periphery of said base wall toward an air suction side and provided with an opening which is open toward said air suction side and on which a stator of said motor is fixedly mounted; and an impeller fixed with respect to a rotor of said motor and including a plurality of blades;

said impeller including a blade mounting wall of a cylindrical shape arranged outside said rotor and mounted on an outer periphery thereof with said blades, said blade mounting wall being provided with an opening which is open toward an air discharge side;

said outer cylindrical wall having an opening-side end positioned on a side of said opening of said outer cylindrical wall and said blade mounting wall having an opening-side end positioned on a side of said opening of said blade mounting wall, said opening-side ends of said outer cylindrical wall and blade mounting wall being so formed that said opening-side end of said outer cylindrical wall is positioned outside said opening-side end of said blade mounting wall and a gap constituting a labyrinth structure is defined between said opening-side ends;

said gap including an outer annular opening which is open outwardly in said radial direction and an inner annular opening which is open inwardly in said radial direction, said outer annular opening being positioned in proximity to said air suction side as compared with said inner annular opening;

said base wall of said motor support being provided at a portion thereof positioned inwardly of said outer cylindrical wall with an inner cylindrical wall, which is arranged in a manner to extend toward said air suction side and provided with an opening open toward said air suction side;

said inner cylindrical wall being provided at an opening-side end thereof positioned on a side of said opening thereof with an annular flange so as to extend outwardly in said radial direction, said annular flange being positioned in proximity to said air suction side as compared with said outer opening of said gap.

2. An air fan as defined in claim 1, wherein said annular flange is provided separately from said inner cylindrical wall and fixed said end of said opening-side end of said inner cylindrical wall.

3. An air fan as defined in claim 1, wherein said annular flange is provided with a first auxiliary cylindrical wall, which is arranged so as to extend toward said air suction side, has an opening open toward said air suction side and is positioned concentrically with said revolving shaft; and said impeller is integrally provided with a second auxiliary cylindrical wall, which is arranged so as to be concentric with said revolving shaft on an outside of said rotor on an inner side of said blade mounting wall in said radial direction and provided with an opening which is open toward said air discharge side;

said opening-side end of said first auxiliary cylindrical wall and said opening-side end of said second auxiliary cylindrical wall being so formed that said opening-side end of said first auxiliary cylindrical wall is positioned outside said opening-side end of said second auxiliary cylindrical wall and a gap constituting a labyrinth structure is formed between both opening-side ends.

4. An air fan as defined in claim 3, wherein said first auxiliary cylindrical wall is integrally provided on an end of said flange positioned outwardly in said radial direction.

5. An air fan as defined in claim 1, wherein said gap includes a first annular passage extending inwardly in said radial direction from said outer opening, a cylindrical passage extending toward said air discharge side while communicating with said first annular passage, and a second annular passage extending inwardly in said radial direction so as to permit said cylindrical passage to communicate with said inner opening.

6. An air fan as defined in claim 1, wherein said annular flange is formed so as to extend outwardly in said radial direction to a degree sufficient to prevent water intruding between said outer cylindrical wall and said inner cylindrical wall through said gap from overflowing said flange.

7. An air fan having a motor incorporated therein so as to act as a drive source and adapted to flow air in an axial direction of a revolving shaft of said motor, comprising:

a casing including a cylindrical inner surface constituting an air duct;

a motor support including a base wall which is provided at a central portion thereof with a bearing holder fixedly mounted therein with bearings for supporting said revolving shaft of said motor and is arranged so as to extend in a radial direction perpendicular to said axial direction of said revolving shaft, as well as an outer cylindrical wall which is arranged so as to extend from an outer periphery of said base wall toward an air suction side, is provided with an opening which is open toward said air suction side and is arranged concentrically with said revolving shaft;

said motor having a stator fixed on said motor support;

a plurality of webs arranged for connecting said motor support to said casing so as to position said motor support in said air duct; and an impeller including a plurality of blades;

said impeller being fixed with respect to a rotor of said motor and arranged in said air duct;

said impeller including a blade mounting wall of a cylindrical shape arranged outside said rotor and mounted on an outer periphery thereof with said blades, said blade mounting wall being arranged concentrically with said revolving shaft and provided with an opening which is open toward an air discharge side;

said outer cylindrical wall having an opening-side end positioned on a side of said opening of said outer cylindrical wall and said blade mounting wall having an opening-side end positioned on a side of said opening of said blade mounting wall, said opening-side ends of said outer cylindrical wall and blade mounting wall being so formed that said opening-side end of said outer cylindrical wall is positioned outside said opening-side end of said blade mounting wall and a gap constituting a labyrinth structure is defined between said opening-side ends;

said gap including an outer annular opening which is open outwardly in said radial direction and an inner annular opening which is open inwardly in said radial direction, said outer annular opening being positioned in proximity to said air suction side as compared with said inner annular opening;

said base wall of said motor support being integrally provided at a portion thereof positioned inwardly in said radial direction as compared with said outer cylindrical wall and outwardly in said radial direction as compared with said stator with an inner cylindrical wall, which is arranged in a manner to extend toward said air suction side and provided with an opening open toward said air suction side;

said inner cylindrical wall being provided at an opening-side end thereof positioned on a side of said opening thereof with an annular flange so as to extend outwardly in said radial direction;

said inner cylindrical wall having a length in said axial direction determined so that said annular flange is positioned in proximity to said air suction side as compared with said outer opening of said gap.

8. An air fan as defined in claim 7, wherein said annular flange is provided separately from said inner cylindrical wall and fixed said end of said opening-side end of said inner cylindrical wall.

9. An air fan as defined in claim 7, wherein said annular flange is provided with a first auxiliary cylindrical wall, which is arranged so as to extend toward said air suction side, has an opening open toward said air suction side and is positioned concentrically with said revolving shaft; and said impeller is integrally provided with a second auxiliary cylindrical wall, which is arranged so as to be concentric with said revolving shaft on an outside of said rotor on an inner side of said blade mounting wall in said radial direction and provided with an opening which is open toward said air discharge side;

said opening-side end of said first auxiliary cylindrical wall and said opening-side end of said second auxiliary cylindrical wall being so formed that said opening-side end of said first auxiliary cylindrical wall is positioned outside said opening-side end of said second auxiliary cylindrical wall and a gap constituting a labyrinth structure is formed between both opening-side ends.

10. An air fan as defined in claim 9, wherein said first auxiliary cylindrical wall is integrally provided on an end of said flange positioned outwardly in said radial direction.

11. An air fan as defined in claim 7, wherein said gap includes a first annular passage extending inwardly in said radial direction from said outer opening, a cylindrical passage extending toward said air discharge side while communicating with said first annular passage, and a second annular passage extending inwardly in said radial direction so as to permit said cylindrical passage to communicate with said inner opening.

12. An air fan as defined in claim 7, wherein said annular flange is formed so as to extend outwardly in said radial direction to a degree sufficient to prevent water intruding between said outer cylindrical wall and said inner cylindrical wall through said gap from overflowing said flange.

* * * * *